US010787897B2

(12) United States Patent
Treviranus et al.

(10) Patent No.: US 10,787,897 B2
(45) Date of Patent: Sep. 29, 2020

(54) ELECTRONIC MODULE HOUSING FOR DOWNHOLE USE

(71) Applicant: BAKER HUGHES INCORPORATED, Houston, TX (US)

(72) Inventors: Joachim Treviranus, Winsen (DE); Stephan Wink, Celle (DE); Olaf Gaertner, Celle (DE); Daniel Porzig, Celle (DE); Tim Mueller, Burgwedel (DE); Andreas Peter, Celle (DE)

(73) Assignee: BAKER HUGHES HOLDINGS LLC, Houston, TX (US)

( * ) Notice: Subject to any disclaimer, the term of this patent is extended or adjusted under 35 U.S.C. 154(b) by 336 days.

(21) Appl. No.: 15/387,995

(22) Filed: Dec. 22, 2016

(65) Prior Publication Data

US 2018/0179882 A1 Jun. 28, 2018

(51) Int. Cl.

| | |
|---|---|
| ***E21B 47/017*** | (2012.01) |
| ***E21B 47/12*** | (2012.01) |
| *E21B 49/00* | (2006.01) |
| *E21B 49/08* | (2006.01) |

(52) U.S. Cl.

CPC ..... *E21B 47/017* (2020.05); *E21B 47/12* (2013.01); *E21B 49/00* (2013.01); *E21B 49/08* (2013.01)

(58) Field of Classification Search

CPC ..... E21B 47/00; E21B 47/011; E21B 47/017

See application file for complete search history.

(56) References Cited

U.S. PATENT DOCUMENTS 4,891,734 A 1/1990 More et al.
5,360,967 A 11/1994 Perkin et al.

(Continued)

FOREIGN PATENT DOCUMENTS

EP 2740889 A1 11/2014

OTHER PUBLICATIONS

Blankenship, Douglas et al., "Development of a High-Temperature Diagnostics-While-Drilling Tool," Sandia Report, 63 pp., SAND2009-0248 (2009).

(Continued)

*Primary Examiner* — Robert E Fuller
*Assistant Examiner* — Lamia Quaim
(74) *Attorney, Agent, or Firm* — Mossman Kumar & Tyler PC

(57) ABSTRACT

Methods, systems, devices, and products for downhole operations. Embodiments include downhole tools comprising an outer member configured for conveyance in the borehole; a pressure barrel positioned inside the outer member; a substantially cylindrical pod positioned inside the pressure barrel; and at least one downhole electronic component mounted between the exterior surface and the frame. The pod comprises at least one rigid outer surface forming an exterior surface of the pod and supported by a central frame extending across a diameter of the pod, such as a plurality of outer rigid surfaces. The pod may include a plurality of coupled rigid elongated semicircular metallic shells, wherein each shell of the plurality comprises a rigid outer surface of the plurality of outer rigid surfaces. Each of the at least one downhole electronic component may be sealingly enclosed within a corresponding shell.

12 Claims, 10 Drawing Sheets

(56) References Cited

U.S. PATENT DOCUMENTS 6,134,892 A * 10/2000 Turner ..... E21B 36/003 166/66
6,311,621 B1 11/2001 Marshall et al.
7,178,607 B2 2/2007 Mayes
7,308,795 B2 12/2007 Hall et al.
7,363,971 B2 4/2008 Rodney et al.
8,726,725 B2 5/2014 Nguyen-Thuyet et al.
2004/0112601 A1* 6/2004 Hache ..... E21B 36/001 166/302
2010/0108306 A1 5/2010 Cooper
2012/0324993 A1* 12/2012 Nakajima ..... E21B 47/011 73/152.47
2013/0087903 A1 4/2013 Cherchali et al.
2013/0235537 A1* 9/2013 Swett ..... E21B 47/011 361/752
2014/0312752 A1 10/2014 Durisotti et al.
2014/0332235 A1 11/2014 Mueller et al.
2015/0000913 A1 1/2015 Lelong-Feneyrou et al.
2015/0226053 A1 8/2015 Mueller et al.
2015/0275652 A1 10/2015 Fanini et al.
2015/0313010 A1* 10/2015 Zhan ..... E21B 47/12 175/50
2015/0330208 A1 11/2015 Haubold et al.
2015/0337641 A1 11/2015 Mueller et al.
2016/0202383 A1 7/2016 Dyer et al.

OTHER PUBLICATIONS

Blankenship, Douglas et al., "Development of a High-Temperature Diagnostics-While-Drilling Tool," Sandia Report SAND2009-0248, Unlimited Release, 63 pp. (Jan. 2009).
PCT Application No. PCT/US2017/067695—International Preliminary Report on Patentability dated Jul. 4, 2019.

* cited by examiner

ELECTRONIC MODULE HOUSING FOR DOWNHOLE USE

FIELD OF THE DISCLOSURE

In one aspect, this disclosure relates generally to borehole tools, and in particular to tools used for drilling a borehole in an earth formation.

BACKGROUND OF THE DISCLOSURE

Drilling wells for various purposes is well-known. Such wells may be drilled for geothermal purposes, to produce hydrocarbons (e.g., oil and gas), to produce water, and so on. Well depth may range from a few thousand feet to 25,000 feet or more. Downhole tools often incorporate various sensors, instruments and control devices in order to carry out any number of downhole operations. Thus, the tools may include sensors and/or electronics for formation evaluation, fluid analysis, monitoring and controlling the tool itself, and so on. Tools typically include one or more printed circuit boards having electrical components attached.

SUMMARY OF THE DISCLOSURE

In aspects, the present disclosure is related to methods and apparatuses for use downhole in subterranean wellbores (boreholes), and, more particularly, in downhole drilling. Apparatus embodiments may include a downhole tool comprising an outer member configured for conveyance in the borehole; a pressure barrel positioned inside the outer member; a substantially cylindrical pod positioned inside the pressure barrel; and at least one downhole electronic component mounted between the exterior surface and the frame. The pod comprises at least one rigid outer surface forming an exterior surface of the pod and supported by a central frame extending across a diameter of the pod. The downhole tool may be part of a tool string of a drilling system.

The at least one rigid outer surface may include a plurality of outer rigid surfaces. The pod may include a plurality of coupled rigid elongated semicircular metallic shells, wherein each shell of the plurality comprises a rigid outer surface of the plurality of outer rigid surfaces. The pod may be configured to allow transverse travel of a first shell of the plurality with respect to a second shell of the plurality within a selected distance range to alleviate a bending force on at least one of the first shell and the second shell from the borehole. At least one shell of the plurality of coupled rigid elongated semicircular metallic shells may include a support member opposite the rigid outer surface of the at least one shell. The frame may comprise the support member of the at least one shell. Each shell of the plurality of coupled rigid elongated semicircular metallic shells may include a support member opposite the rigid outer surface of each shell, and the frame may comprise the support member of each shell.

Each of the at least one downhole electronic component may be sealingly enclosed within a corresponding shell of the plurality. The support of the pod inside the pressure barrel may be configured to allow transverse travel of the pod with respect to the pressure barrel within a selected distance range to alleviate a bending force acting on the pressure barrel through deformation of the outer member caused by the shape of the surrounding borehole. The apparatus may include shock absorbers coupling the pressure barrel and the pod. The frame may comprise a material having a coefficient of thermal expansion substantially the same as a second coefficient of thermal expansion of at least one material of the at least one electronic component. The at least one downhole electronic component may be mounted to the frame. The at least one downhole electronic component may comprise a circuit board. The circuit board may be predominantly made of ceramic material.

Examples of some features of the disclosure may be summarized rather broadly herein in order that the detailed description thereof that follows may be better understood and in order that the contributions they represent to the art may be appreciated.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION

Figure 1:
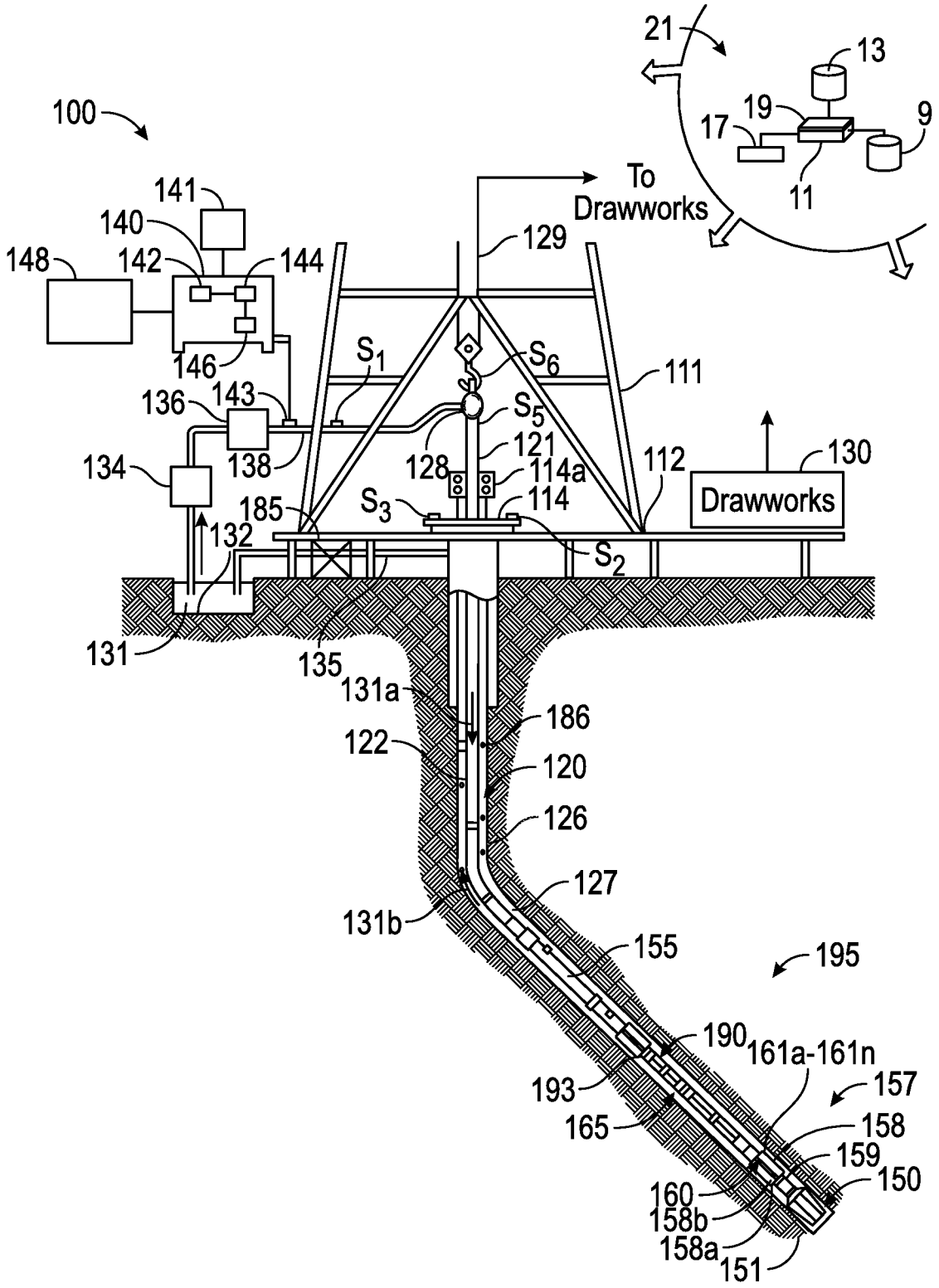
FIG. 1 shows a schematic diagram of an example drilling system in accordance with embodiments of the present disclosure for evaluating a condition of a component of a drillstring.

Aspects of the present disclosure relate to improvements in housings for electronic components for use downhole (e.g., in subterranean boreholes intersecting the formation), such as multi-chip modules (MCMs), printed circuit boards, and other electronics. Aspects include apparatus for drilling boreholes and for downhole logging including one or more tools including a housing adapted for the rigors of such applications.

Traditional printed circuit boards have been around for many decades. A printed circuit board (PCB) is a plate or board comprising a substrate supporting different elements that make up an electrical circuit that contains the electrical interconnections between them. The substrate is typically made from epoxy resin.

Measurement-while-drilling and logging-while-drilling (MWD/LWD) tools experience demanding conditions, including elevated levels of vibration, shock, and heat. Vibration and shock experienced by the components of a MWD/LWD tool may reach levels of greater than 50 gravitational units (gn). Severe downhole vibrations can damage drilling equipment including the drill bit, drill collars, stabilizers, MWD/LWD, and Rotary Steerable System (RSS). Further, MWD/LWD tools continue to be exposed to ever hotter environments.

Ceramic substrates have displayed increased resistance to these elevated temperature levels. However, downhole electronic components in general, and ceramic substrate components particularly, necessitate more exacting specifications with respect to mechanical rigidity. This is exacerbated by the space constraints of the downhole tool, where standard MCM housings to date have resulted in long electronic sections, and by the typical mounting technique of adhering (gluing) the ceramic board to a mounting surface of the electronic component housing. Aspects of the present disclosure include improvements mitigating spacing and rigidity issues inherent in previous electronic component housings.

In aspects, the present disclosure includes an apparatus for drilling a borehole in an earth formation, for performing well logging in a borehole intersecting an earth formation, and so on. Apparatus embodiments may include a downhole tool comprising an outer member configured for conveyance in the borehole; a pressure barrel positioned inside the outer member; and a substantially cylindrical pod positioned inside the pressure barrel. The pod may include at least one rigid outer surface forming an exterior surface of the pod and supported by a central frame extending across a diameter of the pod. The frame may be made up of metal. Embodiments include at least one downhole electronic component mounted between the exterior surface and the frame.

Techniques described herein are particularly suited for use in measurement of values of properties of a formation downhole or of a downhole fluid while drilling, through the use of instruments which may utilize components as described herein. These values may be used to evaluate and model the formation, the borehole, and/or the fluid, and for conducting further operations in the formation or the borehole.

In some implementations, the above embodiments may be used as part of a drilling system. FIG. 1 shows a schematic diagram of an example drilling system in accordance with embodiments of the present disclosure for evaluating a condition of a component of a drillstring. FIG. 1 shows a drillstring (drilling assembly) 120 that includes a bottomhole assembly (BHA) 190 conveyed in a borehole 126. The drilling system 100 includes a conventional derrick 111 erected on a platform or floor 112 which supports a rotary table 114 that is rotated by a prime mover, such as an electric motor (not shown), at a desired rotational speed. A tubing (such as jointed drill pipe 122), having the drillstring 190, attached at its bottom end extends from the surface to the bottom 151 of the borehole 126. A drillbit 150, attached to drillstring 190, disintegrates the geological formations when it is rotated to drill the borehole 126. The drillstring 120 is coupled to a drawworks 130 via a Kelly joint 121, swivel 128 and line 129 through a pulley. Drawworks 130 is operated to control the weight on bit ("WOB"). The drillstring 120 may be rotated by a top drive (not shown) instead of by the prime mover and the rotary table 114. Alternatively, a coiled-tubing may be used as the tubing 122. A tubing injector 114*a* may be used to convey the coiled-tubing having the drillstring attached to its bottom end. The operations of the drawworks 130 and the tubing injector 114*a* are known in the art and are thus not described in detail herein.

A suitable drilling fluid 131 (also referred to as the "mud") from a source 132 thereof, such as a mud pit, is circulated under pressure through the drillstring 120 by a mud pump 134. The drilling fluid 131 passes from the mud pump 134 into the drillstring 120 via a desurger 136 and the fluid line 138. The drilling fluid 131*a* from the drilling tubular discharges at the borehole bottom 151 through openings in the drillbit 150. The returning drilling fluid 131*b* circulates uphole through the annular space 127 between the drillstring 120 and the borehole 126 and returns to the mud pit 132 via a return line 135 and drill cutting screen 185 that removes the drill cuttings 186 from the returning drilling fluid 131*b*.

In some applications, the drillbit 150 is rotated by only rotating the drill pipe 122. However, in many other applications, a downhole motor 155 (mud motor) disposed in the drillstring 190 also rotates the drillbit 150. The rate of penetration (ROP) for a given BHA largely depends on the WOB or the thrust force on the drillbit 150 and its rotational speed.

The mud motor 155 is coupled to the drillbit 150 via a drive shaft disposed in a bearing assembly 157. The mud motor 155 rotates the drillbit 150 when the drilling fluid 131 passes through the mud motor 155 under pressure. The bearing assembly 157, in one aspect, supports the radial and axial forces of the drillbit 150, the down-thrust of the mud motor 155 and the reactive upward loading from the applied weight-on-bit.

A surface control unit or controller 140 receives signals from the downhole sensors and devices via a sensor 143 placed in the fluid line 138 and signals from sensors S1-S6 and other sensors used in the system 100 and processes such signals according to programmed instructions provided to the surface control unit 140. The surface control unit 140 displays desired drilling parameters and other information on a display/monitor 141 that is utilized by an operator to control the drilling operations. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 may further communicate with a remote control unit 148. The surface control unit 140 may process data relating to the drilling operations, data from the sensors and devices on the surface, data received from downhole, and may control one or more operations of the downhole and surface devices. The data may be transmitted in analog or digital form.

The BHA 190 may also contain formation evaluation sensors or devices (also referred to as measurement-while-drilling ("MWD") or logging-while-drilling ("LWD") sensors) determining resistivity, density, porosity, permeability, acoustic properties, nuclear-magnetic resonance properties, formation pressures, properties or characteristics of the fluids downhole and other desired properties of the formation 195 surrounding the BHA 190. Such sensors are generally known in the art and for convenience are generally denoted herein by numeral 165. The BHA 190 may further include other sensors and devices 159 for determining one or more properties of the BHA 190 generally (such as vibration, acceleration, oscillations, whirl, stick-slip, etc.) and general drilling operating parameters (such as weight-on-bit, fluid flow rate, pressure, temperature, rate of penetration, azimuth, tool face, drillbit rotation, etc.) For convenience, all such sensors are denoted by numeral 159.

The BHA 190 may include a steering apparatus or tool 158 for steering the drillbit 150 along a desired drilling path. In one aspect, the steering apparatus may include a steering unit 160, having a number of force application members 161*a*-161*n*, wherein the steering unit is at partially integrated into the drilling motor. In another embodiment the steering apparatus may include a steering unit 158 having a bent sub and a first steering device 158*a* to orient the bent sub in the wellbore and the second steering device 158*b* to maintain the bent sub along a selected drilling direction.

Suitable systems for making dynamic downhole measurements include COPILOT, a downhole measurement system, manufactured by BAKER HUGHES INCORPORATED. Any or all of these sensors may be used in carrying out the methods of the present disclosure.

The drilling system 100 can include one or more downhole processors at a suitable location such as 193 on the BHA 190. The processor(s) can be a microprocessor that uses a computer program implemented on a suitable non-transitory computer-readable medium that enables the processor to perform the control and processing. Other equipment such as power and data buses, power supplies, and the like will be apparent to one skilled in the art. In one embodiment, the MWD system utilizes mud pulse telemetry to communicate data from a downhole location to the surface while drilling operations take place. Other embodiments could include wired pipe telemetry, wire telemetry in coiled tubing, electro-magnetic telemetry, acoustic telemetry, and so on. The surface processor 142 can process the surface measured data, along with the data transmitted from the downhole processor, to evaluate a condition of drillstring components. While a drillstring 120 is shown as a conveyance system for sensors 165, it should be understood that embodiments of the present disclosure may be used in connection with tools conveyed via rigid (e.g. jointed tubular or coiled tubing) as well as non-rigid (e. g. wireline, slickline, e-line, etc.) conveyance systems. The drilling system 100 may include a bottomhole assembly and/or sensors and equipment for implementation of embodiments of the present disclosure. A point of novelty of the system illustrated in FIG. 1 is that the surface processor 142 and/or the downhole processor 193 are configured to perform certain methods (discussed below) that are not in the prior art.

Certain embodiments of the present disclosure may be implemented with a hardware environment that includes an information processor 11, an information storage medium 13, an input device 17, processor memory 19, and may include peripheral information storage medium 9. The hardware environment may be in the well, at the rig, or at a remote location. Moreover, the several components of the hardware environment may be distributed among those locations. The input device 17 may be any data reader or user input device, such as data card reader, keyboard, USB port, etc. The information storage medium 13 stores information provided by the detectors. Information storage medium 13 may include any non-transitory computer-readable medium for standard computer information storage, such as a USB drive, memory stick, hard disk, removable RAM, EPROMs, EAROMs, flash memories and optical disks or other commonly used memory storage system known to one of ordinary skill in the art including Internet based storage. Information storage medium 13 stores a program that when executed causes information processor 11 to execute the disclosed method. Information storage medium 13 may also store the formation information provided by the user, or the formation information may be stored in a peripheral information storage medium 9, which may be any standard computer information storage device, such as a USB drive, memory stick, hard disk, removable RAM, or other commonly used memory storage system known to one of ordinary skill in the art including Internet based storage. Information processor 11 may be any form of computer or mathematical processing hardware, including Internet based hardware. When the program is loaded from information storage medium 13 into processor memory 19 (e.g. computer RAM), the program, when executed, causes information processor 11 to retrieve detector information from either information storage medium 13 or peripheral information storage medium 9 and process the information to estimate a parameter of interest. Information processor 11 may be located on the surface or downhole. Some of these media may also be used for data storage on the BHA.

The term "information" as used herein includes any form of information (analog, digital, EM, printed, etc.). As used herein, a processor is any information processing device that transmits, receives, manipulates, converts, calculates, modulates, transposes, carries, stores, or otherwise utilizes information. In several non-limiting aspects of the disclosure, an information processing device includes a computer that executes programmed instructions for performing various methods. These instructions may provide for equipment operation, control, data collection and analysis and other functions in addition to the functions described in this disclosure. The processor may execute instructions stored in computer memory accessible to the processor, or may employ logic implemented as field-programmable gate arrays ('FPGAs'), application-specific integrated circuits ('ASICs'), other combinatorial or sequential logic hardware, and so on.

The surface control unit 140 may further communicate with a remote control unit 148. The surface control unit 140 may process data relating to the drilling operations, data from the sensors and devices on the surface, and data received from downhole; and may control one or more operations of the downhole and surface devices. The data may be transmitted in analog or digital form.

Surface processor 142 or downhole processor 193 may also be configured to control steering apparatus 158, mud pump 134, drawworks 130, rotary table 114, downhole motor 155, other components of the BHA 190, or other components of the drilling system 101. Surface processor 142 or downhole processor 193 may be configured to control sensors described above and to estimate a parameter of interest according to methods described herein.

Control of these components may be carried out using one or more models using methods described below. For example, surface processor 142 or downhole processor 193 may be configured to modify drilling operations i) autonomously upon triggering conditions, ii) in response to operator commands, or iii) combinations of these. Such modifications may include changing drilling parameters, steering the drillbit (e.g., geosteering), altering the drilling fluid program, activating well control measures, and so on. Control of these devices, and of the various processes of the drilling system generally, may be carried out in a completely automated fashion or through interaction with personnel via notifications, graphical representations, user interfaces and the like. Reference information accessible to the processor may also be used. In some general embodiments, surface processor 142, downhole processor 193, or other processors (e.g. remote processors) may be configured to operate the well logging tool 110 to make well logging measurements. Each of these logical components of the drilling system may be implemented as one or more electrical components, such as integrated circuits (ICs) housed in a protective substantially cylindrical pod positioned in a pressure barrel.

Improved Housing for Multi-Chip Module (MCM) Electronics

General embodiments of the present disclosure may include a tool for performing well logging in a borehole intersecting an earth formation. The tool may include a printed circuit board used in operation of the tool.

Figure 2B:
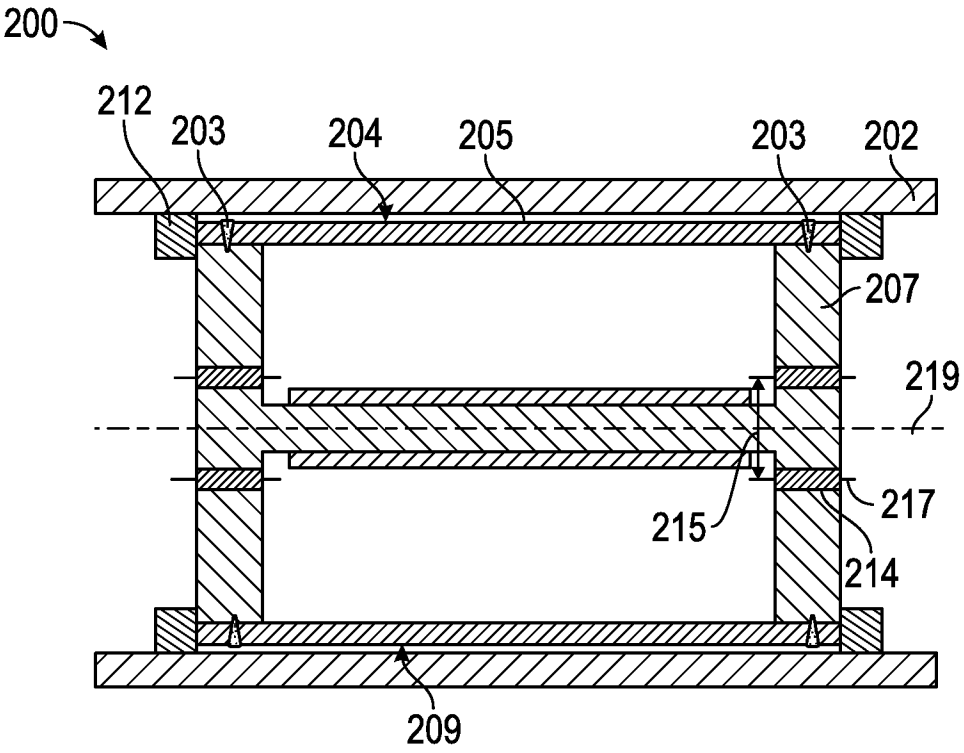
FIGS. 2A & 2B illustrate a device in accordance with embodiments of the present disclosure.
Figure 2A:
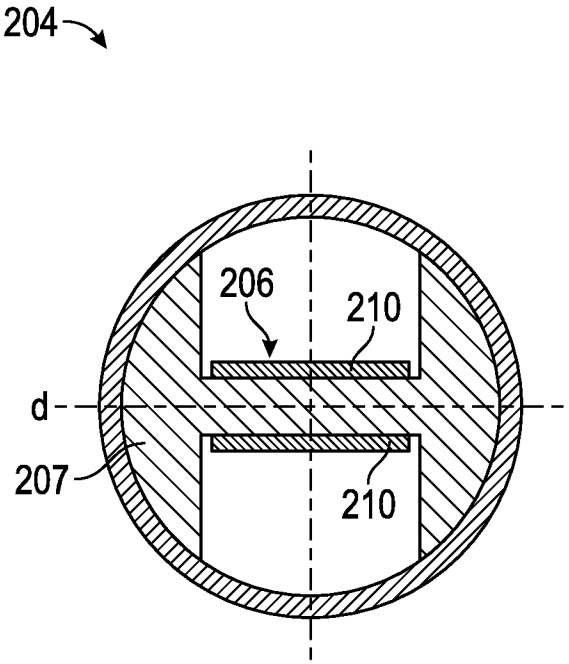

FIGS. 2A & 2B illustrate a device in accordance with embodiments of the present disclosure. Device 200 includes a pressure barrel 202 configured to be positioned inside the outer member a downhole tool. The device 200 also includes a substantially cylindrical pod 204 positioned inside the pressure barrel 202. The pod 204 may be hermetically sealed. The pressure barrel 202 is configured to withstand environmental pressures along the drilling depths traveled by the tool. In operation, the pod has very little deflection, even in the presence of extreme outer loads on the pressure barrel.

The pod 204 comprises at least one rigid outer surface 205 forming an exterior surface of the pod 204. The rigid outer surface 205 is supported by a central frame 206 extending across a diameter (d) of the pod. The rigid outer surface 205 may be part of a cover 209 welded in place, e.g., at weld seams 203. The central frame 206 extends along a longitudinal axis 219 of the tool. The central frame 206 may be part of a larger frame system 207. The frame 206 itself is also curved to match the outer surface 205, thereby forming a semicircular arch at a cross section.

Downhole electronic component(s) 210 is mounted between the exterior surface 204 and the frame 206. In accordance with embodiments shown in FIGS. 2A & 2B, central frame 206 provides a mounting surface comprised of two flat areas on which components (e.g., substrates) may be disposed. Downhole electronic components 210 may include, for example, MCMs PCBs, other ICs or circuitry, and so on. All or a portion of central frame 206 may comprise a material having a coefficient of thermal expansion substantially the same as a second coefficient of thermal expansion of at least one material of the at least one electronic component (e.g., the board, MCM, etc.). For example ceramic circuit boards have a coefficient of thermal expansion substantially the same as titanium or the nickel-cobalt ferrous alloy kovar.

Shock absorbers 212 may bias the rigid outer surface 205 away from the pressure barrel 202. Shock absorbers 212 protect the downhole electronics from mechanics and dynamic forces, and support hybrid electronics in the barrel. Connectors 214, which may be implemented in standard multiple connector shapes, provide a hermetically sealed operative connection traversing the frame system or other components implementing the hermetic seal. Internal connectors 215 may be coupled with internal electronics, including (ultimately) electronic components 210. Outer connector 217 may be implemented using cables, solder caps, standard connectors (e.g., MDM, contact block), or a floating connector.

Figure 3A:
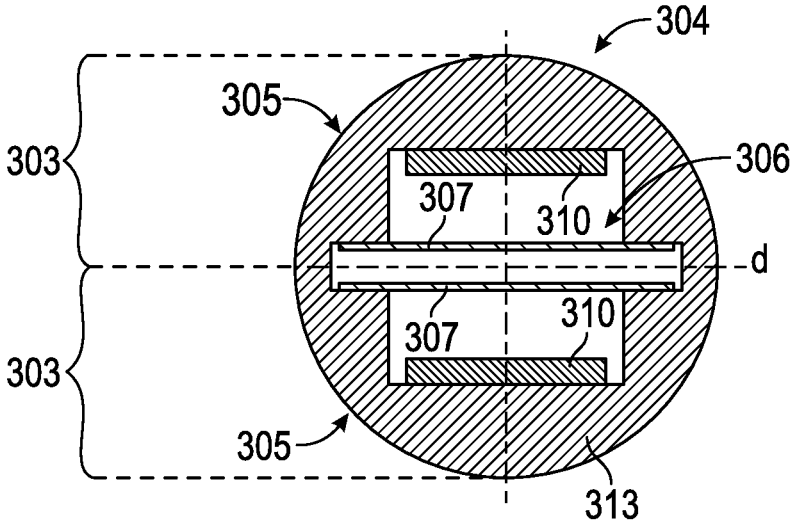
FIGS. 3A & 3B illustrate another pod in accordance with embodiments of the present disclosure.
Figure 3B:
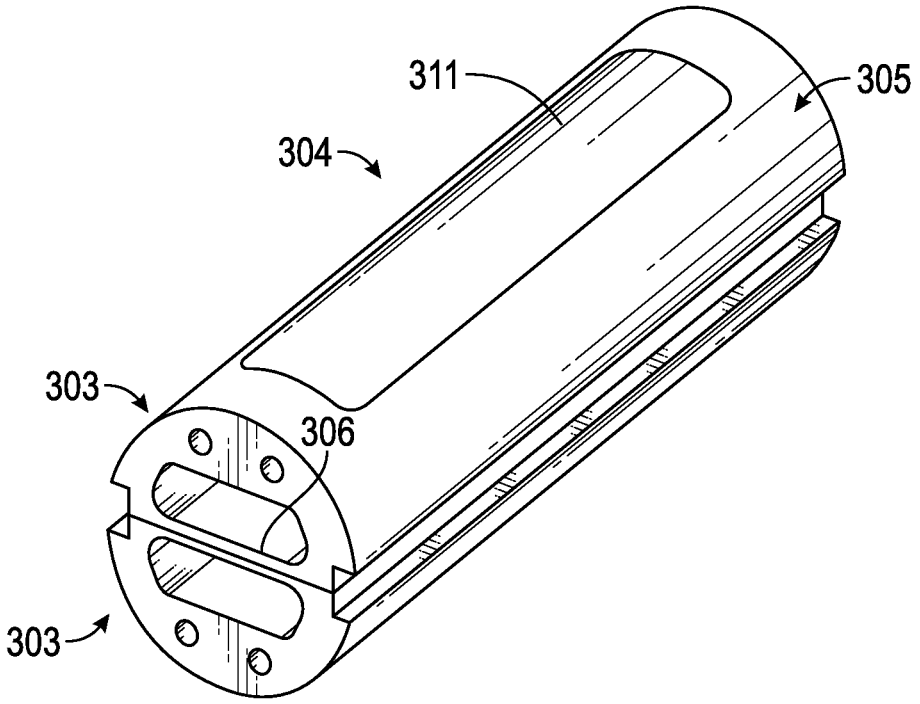
Figure 3C:
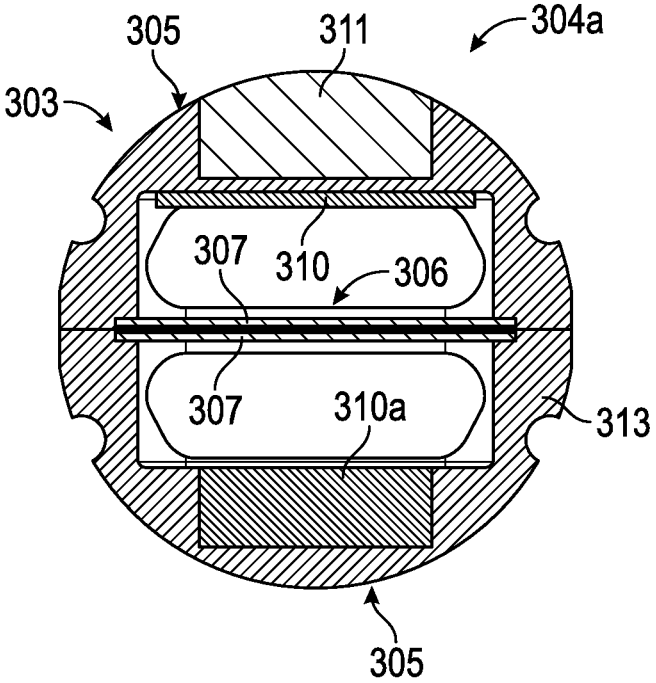
FIG. 3C is a cross-sectional view illustrating another pod in accordance with embodiments of the present disclosure.

FIGS. 3A & 3B illustrate another pod in accordance with embodiments of the present disclosure. FIG. 3A shows cross-sectional view of pod 304. FIG. 3B shows a perspective view of pod 304. Pod 304 includes rigid outer surfaces 305. The pod 304 comprises coupled rigid elongated semicircular metallic shells 303, wherein each shell of the plurality comprises a rigid outer surface 305 of the plurality of outer rigid surfaces. Each shell 303 of the plurality of coupled rigid elongated semicircular metallic shells 303 comprises a support member 307 opposite the rigid outer surface 305 of each shell. In this way the frame 306 comprises the support member 307 of each shell 303. The support member 307 may comprise a cover (lid) hermetically sealing an interior to a base body 313, as well as portions of the base body proximate the diameter. Base body 313 may include one or more integrated connectors. As before, the rigid outer surface 305 is supported by a central frame 306 extending across a diameter (d) of the pod. FIG. 3C is a cross-sectional view illustrating another pod in accordance with embodiments of the present disclosure. Pod 304*a* comprises additional space for electronic components 310*a*.

The coupled rigid elongated semicircular metallic shells may be welded together, bolted together, glued, soldered, or otherwise fastened. For particular mechanically coupled embodiments, the pod may be configured to allow transverse travel of a first shell of the plurality of shells with respect to a second shell of the plurality within a selected distance range. This relative travel may alleviate a bending force on at least one of the first shell and the second shell from the borehole. Downhole electronic component(s) 310 are mounted between the exterior surface 305 and the frame 306, e.g., proximate the bottom of a pocket machined into the base body 313. As shown, conductive heat abatement member (heat spreader) 311 may be incorporated on the exterior of one or more surfaces 305. This is especially useful when materials of the frame having appropriate coefficients of thermal expansion are not adequate thermal conductors.

Figure 4A:
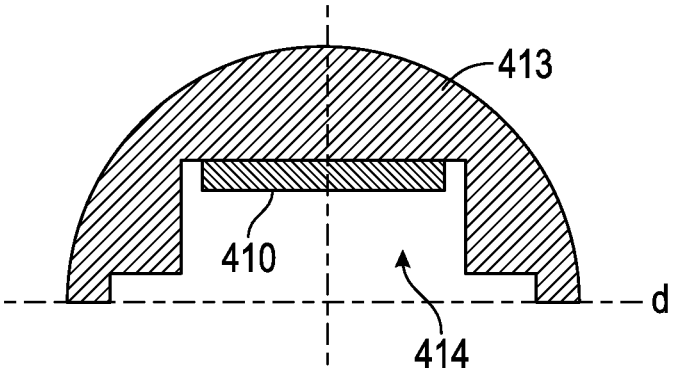
FIGS. 4A-4C show a cross-sectional views illustrating construction of the pod in accordance with embodiments of the present disclosure.
Figure 4B:
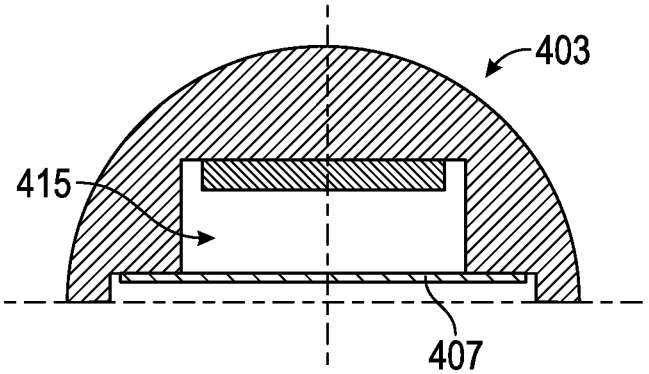
Figure 4C:
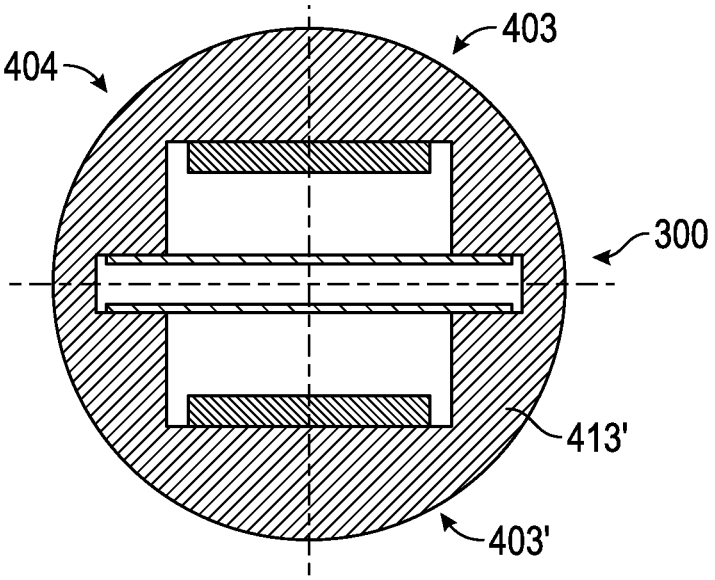

FIGS. 4A-4C show a cross-sectional views illustrating construction of the pod in accordance with embodiments of the present disclosure. Beginning at FIG. 4A, a base body 413 may be formed, machined (e.g., milled), or otherwise fabricated from durable metals. Pocket 414 may be preformed or milled. The base body 413 cross section (perpendicular to the longitudinal axis) is semi-circular. An electronic component (e.g., MCM) is mounted in the housing facing the diameter (d) of the equally bisected circle. Referring to FIG. 4B, a lid 407 may be welded or otherwise joined to the body, which may hermetically close the pocket 414 to create a cavity and form the shell 403. Each of the at least one downhole electronic component is sealingly enclosed within a corresponding shell of the plurality. Pocket 414 may be additionally or alternatively sealed to create a hermetically sealed cavity 415. Referring to FIG. 4C, a second base body 413' may be prepared in the same way described above to produce shell 403'. During assembly, shell 403 may be mounted on shell 403' to produce a substantially cylindrical pod 404 with two MCMs (one on either side of the pod).

Figure 4D:
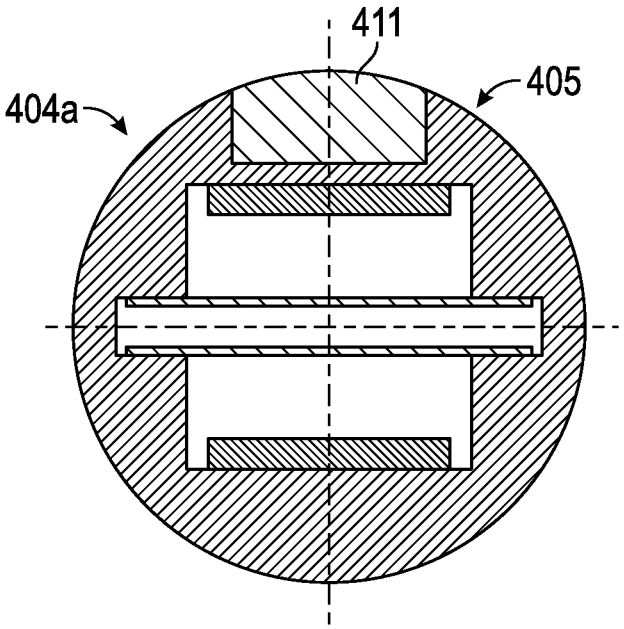
FIGS. 4D-4F show cross-sectional views of other pods in accordance with embodiments of the present disclosure.
Figure 4E:
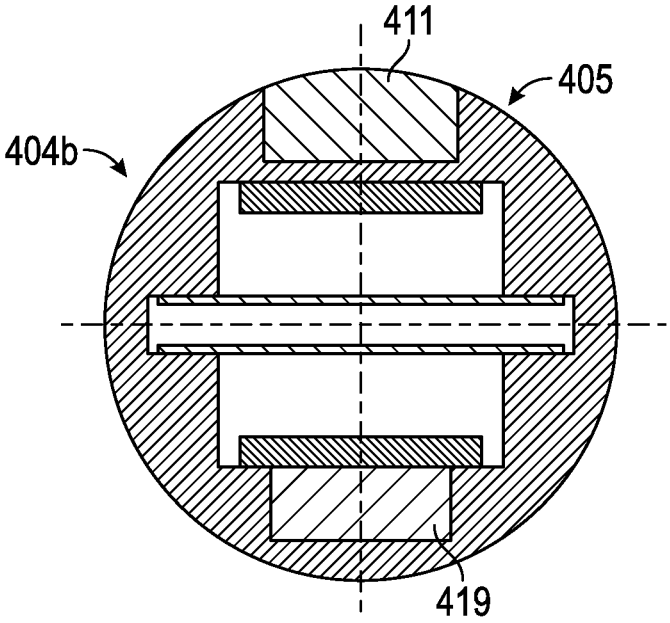
Figure 4F:
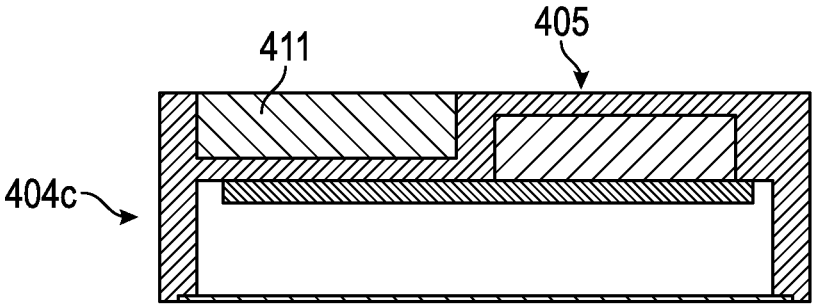

One advantage of employing a plurality of shells in the pod is that the interior of each shell may be specifically fabricated (e.g., milled) to particular specifications. FIGS. 4D-4F show cross-sectional views of other pods in accordance with embodiments of the present disclosure. One or more conductive heat abatement members (heat spreaders) 411 may be incorporated in pods 404*a*, 404*b*, 404*c*, such as, for example, on the exterior of one or more surfaces 405. Additional spaces, such as well 419 may be created for specialty electronics components. These pockets may be placed on either the interior or exterior surface of the shell as design considerations demand, and may be placed symmetrically opposite one another, alone, or end to end.

Figure 4G:
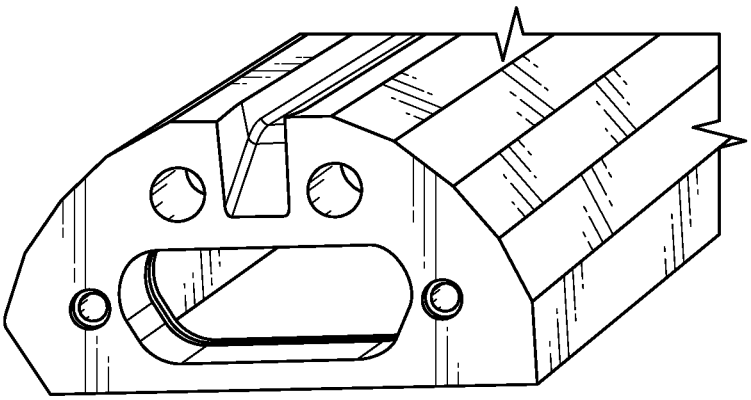
FIG. 4G is a perspective view illustrating another shell in accordance with embodiments of the present disclosure.

FIG. 4G is a perspective view illustrating another shell in accordance with embodiments of the present disclosure. The substantially cylindrical pod may include a plurality of arched components sharing an interior void. Examples would include a pod made up of shells comprising a base body having an outer surface consisting of three or more facets. Shell 498, for example, comprises a base body having an outer surface consisting of a multitude of facets 499. A multitude as used herein refers to 8 or more facets. Shell 498 has 11 facets. Advantages of this design include cost reduction in manufacturing and improved handing of parts. For example, shell 498 resists rolling and can be better clamped down for machining.

Figure 5A:
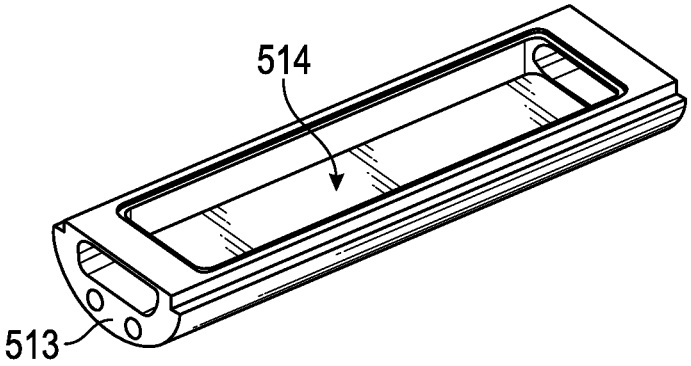
FIGS. 5A-5C show a perspective views illustrating construction of another shell in accordance with embodiments of the present disclosure.
Figure 5B:
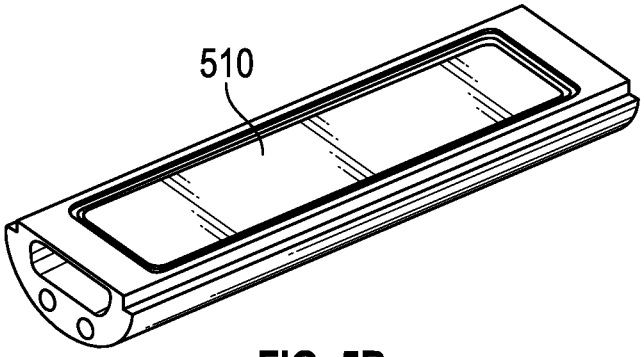
Figure 5C:
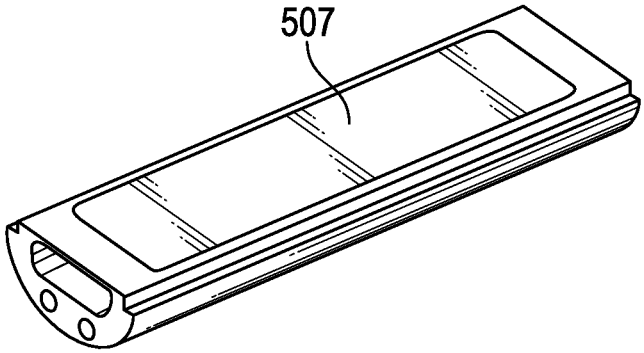

FIGS. 5A-5C show a perspective views illustrating construction of another shell in accordance with embodiments of the present disclosure. Beginning at FIG. 5A, a base body 513, including pocket 514, may be formed from durable metals. Referring to FIG. 5B, an electronic component (e.g., MCM) 510 is mounted in the housing proximate the diameter of the bisected circle. Referring to FIG. 4C, a lid 507 may be welded or otherwise joined to the body, which may hermetically close the pocket 514, and thus form the shell.

Figure 6A:
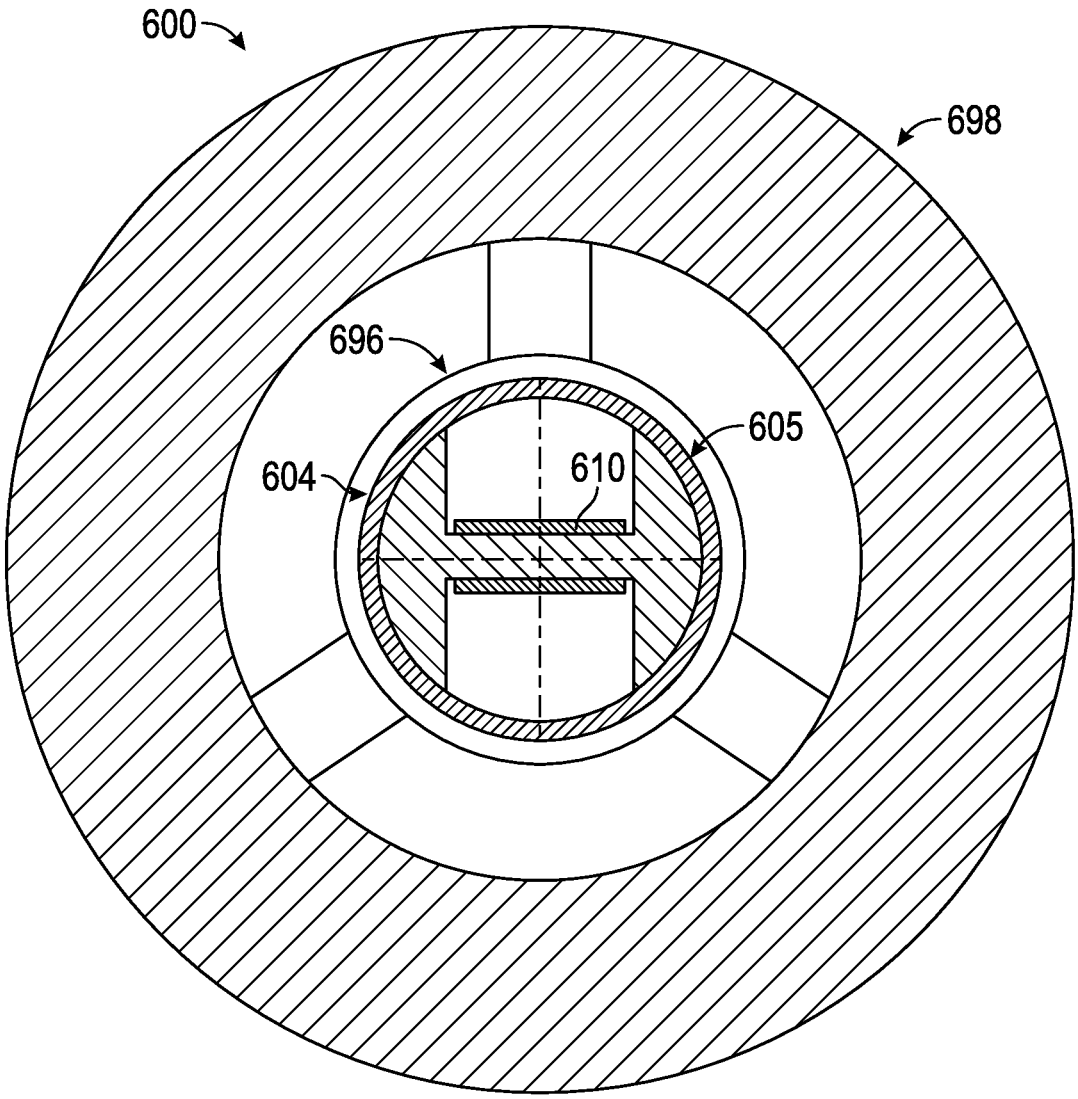
FIGS. 6A & 6B show cross-sectional views illustrating devices in accordance with embodiments of the disclosure.
Figure 6B:
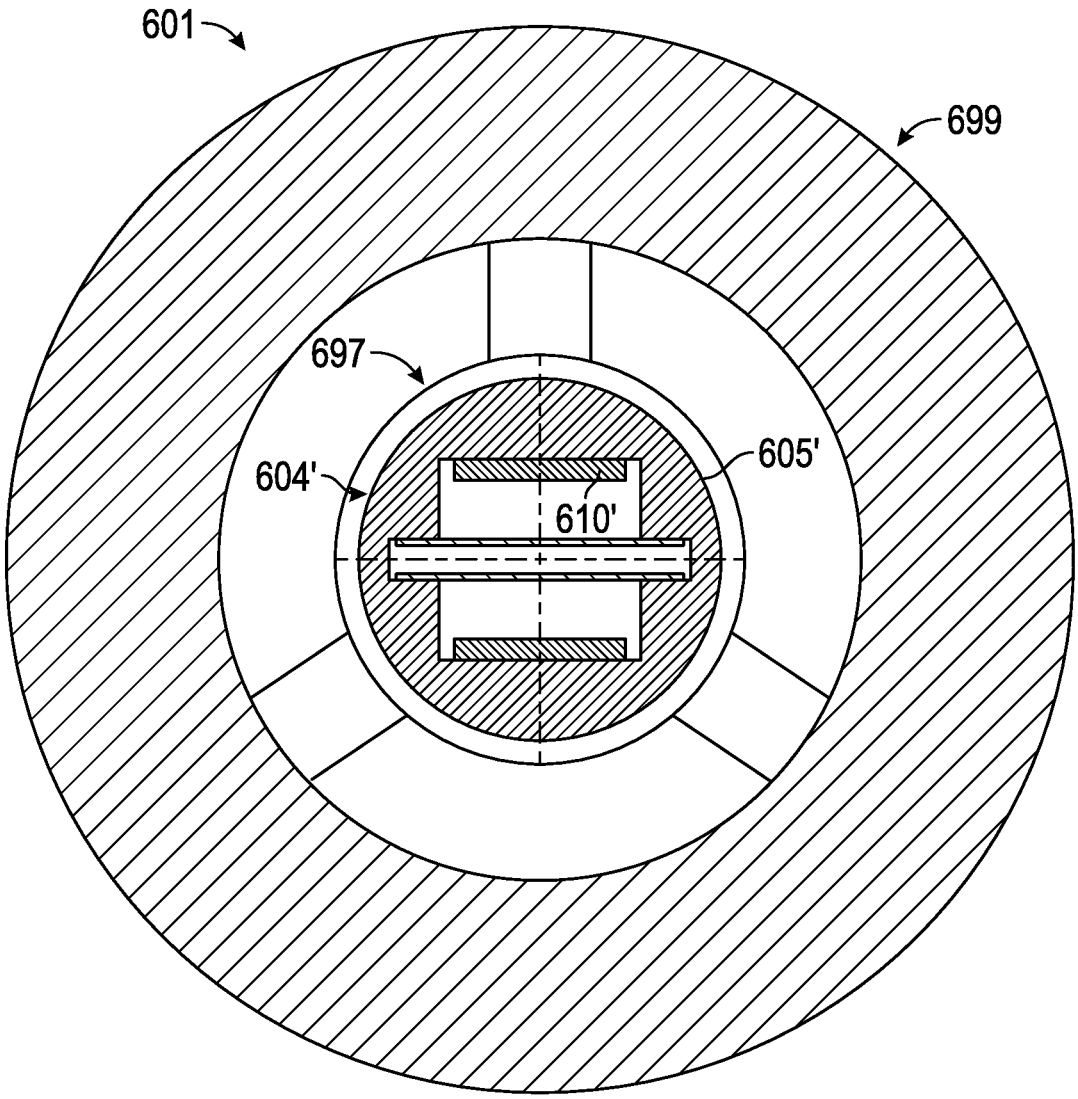

FIGS. 6A & 6B show cross-sectional views illustrating devices in accordance with embodiments of the disclosure. The devices comprise downhole tools 600, 601. In some implementations, tools 600 and 601 may contain sensors 159 and/or 165, or components thereof, as described above with reference to FIG. 1. Each tool comprises an outer member (e.g., drill collar) 698, 699 configured for conveyance in the borehole, a pressure barrel 696, 697 positioned inside the outer member, and a substantially cylindrical pod 604, 604' positioned inside the pressure barrel. Each pod comprises at least one rigid outer surface 605, 605' forming an exterior surface of the pod and supported by a central frame extending across a diameter of the pod. At least one downhole electronic component 610, 610' is mounted between the exterior surface and the frame.

Figure 6C:
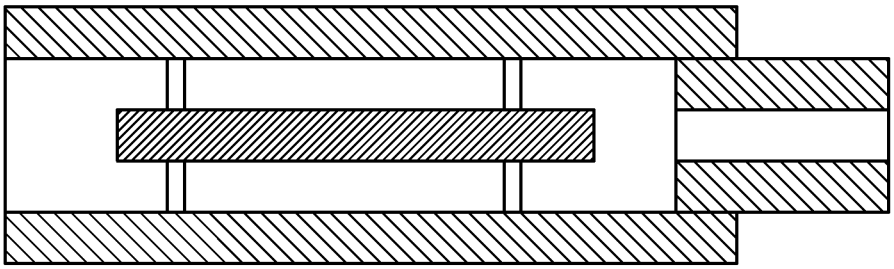
FIGS. 6C-6E show cross-sectional views along the longitudinal axis illustrating devices in accordance with embodiments of the disclosure.
Figure 6D:
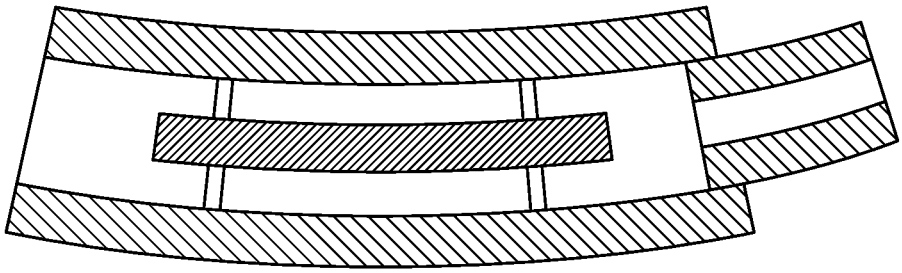
Figure 6E:
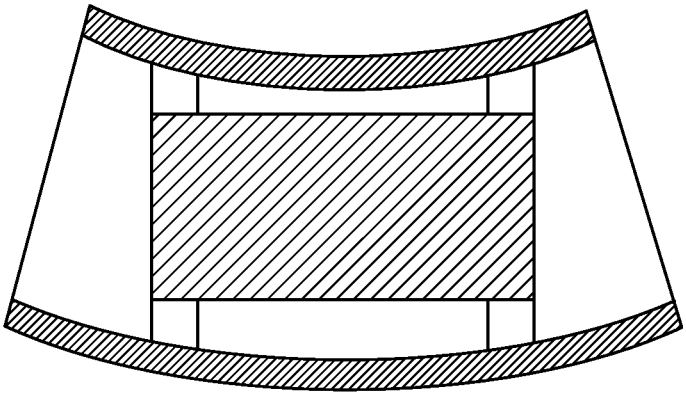

FIGS. 6C-6E show cross-sectional views along the longitudinal axis illustrating devices in accordance with embodiments of the disclosure. Devices of the present disclosure show improved resistance to a bending moment placed on the tool in the borehole. FIG. 6C shows the tool in a straight hole. FIG. 6D shows the tool in a curved hole. As the tool travels through a curved hole, a bending moment is applied on the tool by the formation. The pressure barrel is mounted in the drill collar by probe retention members. The pressure barrel may be configured to bend to a lesser extent than the drill collar. This is not required in consideration of the features described above, however, and alternative configurations may be preferable in some applications.

Referring to FIG. 6E, even when the pressure barrel bends in response to the bending moment applied, the round pod containing the electrical components, also referred to as an electronics housing, remains straight due to the high degree of stiffness. Additionally, support of the pod inside the pressure barrel is configured to allow transverse travel of the pod with respect to the pressure barrel within a selected distance range to alleviate a bending force acting on the pressure barrel through deformation of the outer member caused by the shape of the surrounding borehole. Thus, in the improved device of the present disclosure, the electronic component housing resist deformation more than the flat, rectangular electronic component housings known in the prior art.

The term "conveyance device" as used above means any device, device component, combination of devices, media and/or member that may be used to convey, house, support or otherwise facilitate the use of another device, device component, combination of devices, media and/or member. Exemplary non-limiting conveyance devices include drill strings of the coiled tube type, of the jointed pipe type and any combination or portion thereof. Other conveyance device examples include casing pipes, wirelines, wire line sondes, slickline sondes, drop shots, downhole subs, BHA's, drill string inserts, modules, internal housings and substrate portions thereof, self-propelled tractors. As used above, the term "sub" refers to any structure that is configured to partially enclose, completely enclose, house, or support a device. The term "information" as used above includes any form of information (Analog, digital, EM, printed, etc.). The term "processor" or "information processing device" herein includes, but is not limited to, any device that transmits, receives, manipulates, converts, calculates, modulates, transposes, carries, stores or otherwise utilizes information. An information processing device may include a microprocessor, resident memory, and peripherals for executing programmed instructions. The processor may execute instructions stored in computer memory accessible to the processor, or may employ logic implemented as field-programmable gate arrays ('FPGAs'), application-specific integrated circuits ('ASICs'), other combinatorial or sequential logic hardware, and so on. Thus, configuration of the processor may include operative connection with resident memory and peripherals for executing programmed instructions.

Method embodiments may include conducting further operations in the earth formation in dependence upon the formation resistivity information, the logs, estimated parameters, or upon models created using ones of these. Further operations may include at least one of: i) extending the borehole; ii) drilling additional boreholes in the formation; iii) performing additional measurements on the formation; iv) estimating additional parameters of the formation; v) installing equipment in the borehole; vi) evaluating the formation; vii) optimizing present or future development in the formation or in a similar formation; viii) optimizing present or future exploration in the formation or in a similar formation; ix) evaluating the formation; and x) producing one or more hydrocarbons from the formation.

As used herein, the term "fluid" and "fluids" refers to one or more gasses, one or more liquids, and mixtures thereof. A "downhole fluid" as used herein includes any gas, liquid, flowable solid and other materials having a fluid property and relating to hydrocarbon recovery. A downhole fluid may be natural or man-made and may be transported downhole or may be recovered from a downhole location. Non-limiting examples of downhole fluids include drilling fluids, return fluids, formation fluids, production fluids containing one or more hydrocarbons, engineered fluids, oils and solvents used in conjunction with downhole tools, water, brine, and combinations thereof. An "engineered fluid" may be used herein to mean a human made fluid formulated for a particular purpose.

Aspects of the present disclosure relate to modeling a volume of an earth formation. The model of the earth formation generated and maintained in aspects of the disclosure may be implemented as a representation of the earth formation stored as information. The information (e.g., data) may be stored on a non-transitory machine-readable medium, transmitted, and rendered (e.g., visually depicted) on a display.

A circuit element is an element that has a non-negligible effect on a circuit in addition to completion of the circuit. By "electronic component housing", it is meant the innermost sealed housing containing an electronic component housing. As used herein, "substantially cylindrical" refers to a plurality of arched components sharing an interior void. Examples would include a cylinder and a pod having a symmetrically arched outer surface consisting of three or more facets.

An adequate thermal conductor, as used herein means a material which is significantly thermally conductive. "Significantly thermally conductive," as defined herein refers to materials having a thermal conductivity greater than 200 watts per meter Kelvin. "Substantially the same" when used to describe the coefficient of thermal expansion, means less than 5 parts per million per Celcius degree difference, less than 1 part per million per Celcius degree difference, or lower.

While the foregoing disclosure is directed to the one mode embodiments of the disclosure, various modifications will be apparent to those skilled in the art. It is intended that all variations be embraced by the foregoing disclosure.

What is claimed is:

1. An apparatus for use in a borehole intersecting an earth formation, the apparatus comprising:

a downhole tool comprising an outer member configured for conveyance in the borehole;

a pressure barrel positioned inside the outer member;

a substantially cylindrical pod positioned inside the pressure barrel, the pod comprising:

a plurality of shells comprising a plurality of rigid outer surfaces together forming an exterior surface of the pod, the exterior surface supported by a central frame extending across a diameter of the pod, wherein at least one shell of the plurality of shells comprises a body defining a pocket on an interior surface of the at least one shell, and a cover joined to the body to hermetically seal the pocket, the central frame comprising the cover;

at least one downhole electronic component mounted in the pocket between the exterior surface and the frame.

2. The apparatus of claim 1, wherein the plurality of shells comprises a plurality of coupled rigid elongated semicircular metallic shells.

3. The apparatus of claim 1, wherein the pod is configured to allow transverse travel of a first shell of the plurality with respect to a second shell of the plurality within a selected distance range to alleviate a bending force on at least one of the first shell and the second shell from the borehole.

4. The apparatus of claim 1, wherein a shell of the plurality of shells comprises a support member opposite a corresponding rigid outer surface of the shell, and wherein the frame comprises the support member of the shell.

5. The apparatus of claim 1, wherein each shell of the plurality of shells comprises a support member opposite the rigid outer surface of each shell, and wherein the frame comprises the support member of each shell.

6. The apparatus of claim 1, wherein the support of the pod inside the pressure barrel is configured to allow transverse travel of the pod with respect to the pressure barrel within a selected distance range to alleviate a bending force acting on the pressure barrel through deformation of the outer member caused by the shape of the surrounding borehole.

7. The apparatus of claim 1, comprising shock absorbers coupling the pressure barrel and the pod.

8. The apparatus of claim 1, wherein the frame comprises a material having a coefficient of thermal expansion less than 5 parts per million per Celcius degree different than a second coefficient of thermal expansion of at least one material of the at least one electronic component.

9. The apparatus of claim 1, wherein the at least one downhole electronic component is mounted to the frame.

10. The apparatus of claim 1, wherein the at least one downhole electronic component comprises a circuit board.

11. The apparatus of claim 10, wherein the circuit board is predominantly made of ceramic material.

12. The apparatus of claim 1, wherein the downhole tool is part of a tool string of a drilling system.

* * * * *